US006126843A

United States Patent [19]

Lang et al.

[11] Patent Number: 6,126,843

[45] Date of Patent: Oct. 3, 2000

[54] PROCESS FOR THE ANTIMICROBIAL TREATMENT OF COOLING LUBRICANTS

[75] Inventors: Siegfried Lang, Ludwigshafen; Bernhard Fussnegger, Kirrweiler; Dietmar Oechsle; Klaus Helmut Feifel, both of Schwäbisch Gmünd; Martin Zeiler, Waldstetten, all of Germany

[73] Assignees: BASF Aktiengesellschaft, Ludwigshafen; Schenk Filterbau GmbH, Waldstetten, both of Germany

[21] Appl. No.: 09/186,479

[22] Filed: Nov. 5, 1998

[30] Foreign Application Priority Data

Nov. 28, 1997 [DE] Germany ..... 197 52 899

[51] Int. Cl.[7] ..... C10M 175/02

[52] U.S. Cl. ..... 210/764; 208/179

[58] Field of Search ..... 210/764, 400, 210/501; 208/179; 123/196

[56] References Cited

U.S. PATENT DOCUMENTS 4,897,202 1/1990 King ..... 210/754
5,925,243 7/1999 Clark et al. ..... 210/206

FOREIGN PATENT DOCUMENTS 196 20 084 11/1997 Germany .

*Primary Examiner*—Duane Smith
*Assistant Examiner*—Betsey J. Morrison
*Attorney, Agent, or Firm*—Keil & Weinkauf

[57] ABSTRACT

A process for treating cooling lubricants to prevent attack by microorganisms using crospovidone-iodine as biocidal substance, wherein the cooling lubricant to be treated is brought into contact with a filter cake which consists essentially of particulate crospovidone-iodine as filter medium.

17 Claims, No Drawings

PROCESS FOR THE ANTIMICROBIAL TREATMENT OF COOLING LUBRICANTS

The present invention relates to a process for the antimicrobial treatment of cooling lubricants using crospovidone-iodine as biocidal substance.

The use of cooling lubricants is indispensable in many sectors of industry, especially the metal-processing industry. Without the use of cooling lubricants, the currently very efficient machining operations would not be possible; their composition must be changed and adapted appropriately for the continually increasing demands.

The term cooling lubricant generally refers to a basic fluid in the form of liquid hydrocarbon compounds with various properties and tasks, which contain other substances according to their use. In DIN 51 385, cooling lubricants are therefore defined and classified according to their use. In practice, it is usually sufficient to classify cooling lubricants into those which are miscible with water and those which are not miscible with water.

The basic substances used for cooling lubricants are both mineral oils and oils from natural raw materials.

Mineral oils consist predominantly of paraffin hydrocarbons, naphthenic hydrocarbons and aromatic hydrocarbons.

Oils from natural raw materials contain, besides triglycerides, also concomitant substances such as, for example, free fatty acids, phosphates, protein, carbohydrates, waxes, coloring matter or aromatic-containing hydrocarbons. Most of these unwanted concomitant substances are removed by refining. Also removed thereby are natural inhibitors such as, for example, tocopherols.

The cooling lubricants also contain, to improve the use properties, additives such as adhesion promoters, emulsifiers, antifoams, additives for high-pressure lubrication, corrosion preventives, detergents and viscosity index improvers.

Water-miscible cooling lubricants are always exposed to microbial attack. Even with properly conducted operations it is virtually impossible to prevent colonization with bacteria, yeasts or other fungi. Microbial colonization moreover takes place through the mixing water, the surfaces of tools and machines, the skin and clothing of the operatives or directly from the air.

However, microorganisms impair the functioning of the cooling lubricant considerably. This loss of function is manifested, depending on the extent of the colonization, by odor formation, a fall in pH, a reduction in the corrosion prevention capacity, a change in the dispersity and thus in the filtration characteristics and instability of the emulsion. The cooling lubricant rapidly becomes unusable thereby.

To prevent attacks by microorganisms, cooling lubricants have to date usually been mixed with biocidal preservatives, for example with formaldehyde donors. However, the disadvantage of this is the allergenic and toxic potential of such preservatives.

Another method generally used for treating contaminated cooling lubricants is to pass them through filters consisting of kieselguhr/perlite or other filtration aids, for example pure, crosslinked polyvinylpyrrolidone (PVPP). However, this method is unsatisfactory in terms of the sterilization efficiency.

German Patent Application P 19620084.9 describes the treatment of cooling lubricants in depth-type filters, wherein the depth-type filters contain a biocidal substance, for example crospovidone-iodine, which is embedded as particles in a framework of fibrous materials such as cellulose fibers. However, filters of this type are uneconomic for the treatment of large amounts of cooling lubricants and are relatively unsuitable because of limited productivity.

It is an object of the present invention to find an improved process for sterilizing cooling lubricants which also allows large amounts to be treated.

We have found that this object is achieved by a process for treating cooling lubricants to prevent attack by microorganisms using crospovidone-iodine as biocidal substance, wherein the cooling lubricant is brought into contact with a filter cake which consists essentially of particulate crospovidone-iodine as filter medium.

Crospovidone-iodine refers to the complex, used according to the invention, of crosslinked polyvinylpyrrolidone (PVPP, crospovidone) and iodine. The iodine bound in this complex is in equilibrium with free iodine. The free iodine, which represents the active component, is continuously replenished from the iodine pool of the complex in a concentration range from 0.2 to 6, preferably 2 to 4, ppm.

The amount of iodine bound in this complex may vary. Products suitable according to the invention have an available iodine content between 1 and 22% by weight, preferably 9 and 20% by weight, particularly preferably between 15 and 18% by weight. The particle sizes of the crospovidone-iodine are in the range from 0.1 to 1000 $\mu$m, preferably between 2 $\mu$m and 400 $\mu$m. The average particle size is preferably between 80 $\mu$m and 120 $\mu$m. The specific surface area is 0.8 to 6 $m^2/g$, preferably 1.2 to 1.5 $m^2/g$ (BET method).

The filter medium consists essentially of pure particulate crospovidone-iodine. It is possible to dispense with conventional filtration aids such as kieselguhr, perlite or cellulose fibers. However, it may, in order to influence the flow rate in the filter medium with regard to the filter effect, be advisable to introduce inert materials into the filter bed, in particular spherical moldings of glass, ceramic, sintered materials or metal balls.

For the treatment to prevent attack by microorganisms, the cooling lubricants are brought into contact with deposits of the filter medium. These deposits of the filter medium, that is to say the filter cake, may be designed vertically or horizontally, cylindrical or flat, depending on the type of filtration apparatus used. The height of the filter cake can be from 0.1 to 100 mm, preferably 40 to 50 mm. If a system comprises a plurality of filter elements, the spacing of the filter elements defines the height of the bed.

The deposits of the filter medium can be introduced at the outset or be produced while the process is in progress. In the second case, the contaminated cooling lubricants are mixed with a homogenized suspension of crospovidone-iodine in the cooling lubricant. The suspension contains crospovidone-iodine in amounts of from 1 to 30% by weight, preferably 5 to 25% by weight, particularly preferably 10 to 15% by weight. The suspension can be added to the cooling lubricant using a metering pump. The added amount of this suspension is 0.5 to 200 ml per liter of cooling lubricant, preferably 1 to 3 ml, particularly preferably 1.5 to 2.5 ml per liter of cooling lubricant to be treated. The used cooling lubricant which has been mixed with the suspension is then passed through a suitable filtration apparatus in which the filter medium is deposited as filter cake but through which the cooling lubricant can pass.

The crospovidone-iodine is preferably stirred into the cooling lubricant to be treated and, after a time between 1 and 300 seconds, placed in the filtration apparatus.

Suitable filtration apparatuses are apparatuses known per se such as belt filters, candle filters or horizontal filters such as deep-bed filters (cf. Ullmann's Encyclopedia of Industrial Chemistry, Fifth Edition, Volume B 2, Chapter 10, pages 26–37).

Belt filters are comparable to normal conveyor belts where the belt is conveyed forward on rolls. A slurry or suspension of filter medium and cooling lubricant is placed on the belt from above, and the cooling lubricant filtrate flows off at the end of the belt or is stripped off. Such belt filters can be operated under gravity, subatmospheric or superatmospheric pressure. If subatmospheric pressure is used, an operating pressure of from 0.1 to 0.5 bar is advisable. In the case of superatmospheric pressure, the operating pressure may be up to 1.5 bar.

The crospovidone-iodine is, as stated, metered into the cooling lubricant which is to be treated and separated from impurities through the cake which is deposited on the belt filter. The volumetric flow with this procedure can be from 100 to 50,000 l/min. The active filter area can be from 0.3 to 4 $m^2$. Suitable as filter support are continuous belts of nylon or cellulose fiber webs. The pore width of the filter support is normally in the range from 10 to 100 $\mu$m. The filter cakes may reach heights of from 0.1 to 50 mm. The contact times with this procedure are less than 10 sec.

Candle filters are also suitable for precoat filtration for the process according to the invention. Candle filters normally consist of tubular elements, it being possible for a plurality of tubular elements to be combined. The material to be treated flows through the tubular systems. The filter medium is retained by a suitable support.

Also suitable are horizontal filters in which a shallow deposit of the filter medium is produced on a suitable filter support. It is moreover possible for a plurality of filter elements to be stacked one on top of the other. Thus, for example, up to 150 filter elements can be arranged one above the other to form filter towers.

The operating pressure with these types of filters can be from 0.1 to 6 bar, with volumetric flows of from 100 to 50,000 l/min. The active filter area can be from 1 to 150 $m^2$. Suitable as filter support are fabrics made of plastics or stainless steel with pore widths in the range from 1 to 100 $\mu$m. The height of the filter cake is generally from 0.2 to 20 mm. If the deposits are produced in situ, the pressure builds up as the height of the filter cake increases.

It is also possible to employ according to the invention deep-bed filters such as, for example, gravel bed filters. The filter support used in these types of filters is a bed of gravel, usually quartz sand, which retains the crospovidone-iodine particles as well as impurities with particle sizes up to >1 $\mu$m. After the bed has become blocked, the filters can be flushed from bottom to top, when particles with a lower specific gravity than the constituents of the bed, that is to say including the PVPP-iodine, are washed out and discarded.

Filter presses are also suitable for carrying out the process according to the invention.

To use the process, it is possible for contaminated cooling lubricant to be withdrawn continuously from the cooling lubricant circulation and fed into the filter apparatus in order, after sterilization, to flow back into the cooling lubricant circulation. As already mentioned, the crospovidone-iodine can be metered continuously into the contaminated cooling lubricant to be treated at a suitable point in order then to produce a deposit of the filter medium in suitable apparatuses in situ. However, the contaminated cooling lubricant can also be passed through a filter bed set up previously.

Large volumes of cooling lubricants can also be sterilized in a simple and efficient manner with the aid of the process according to the invention. The sterilizing efficiency is distinctly improved by comparison with conventional filters with kieselguhr/perlite mixtures or pure PVPP as filtration medium.

EXAMPLE 1

Deposit on belt filters (supplied by Mägerle)

Operating pressure: atmospheric pressure

Volumetric flow: 1000 l/min

Active filter area: 2 $m^2$

Filter support: continuous belt of nylon, pore width 50 $\mu$m

Amount of filter medium: 3 g of crospovidone-iodine/l of cooling lubricant

Filter cake height: 15 mm

Contact time: <10 sec

EXAMPLE 2

Deposit on horizontal filters (type ZHF 130 D4 supplied by Schenk Filterbau GmbH)

Operating pressure: 0.1 to 6.0 bar

Volumetric flow: 1500 l/min

Active filter area: 100 $m^2$

Filter support: stainless steel fabric, pore width 55 $\mu$m

Amount of filter medium: 4.0 g of crospovidone-iodine/l of cooling lubricant

Filter cake height: 45 mm maximum; 3 mm initial deposit

Contact time: 4 min

Sterilization of bacteria-containing cooling lubricants

The deposits of filter media prepared in this way were subjected to a validation with a cooling lubricant based on mineral oil (Avilub Metacon® BLU, supplied by Bantleon) which contains $10^7$ organisms per ml, based on the test method 4.2. Titer reduction of the technical/analytical group in the European technical association for deep-bed filtration. This test method is based on DIN 58355, Part 3, Bacteria-retaining capacity of membrane filters.

In the tests which were carried out, a deposit produced in accordance with the preparation example was compared with an identical deposit in which the crospovidone-iodine was replaced by pure PVPP or by a kieselguhr/perlite mixture.

The results are indicated in LRVs (LRV=logarithmic reduction value).

| | LRV |
|---|---|
| Deposit of 100% crospovidone-iodine[+)] | 9 |
| Deposit of PVPP | 1 |
| Deposit of kieselguhr/perlite | 2 |

[+)]PVPP-$I_2$ with an average particle diameter of 105 $\mu$m, an available iodine content of 17.6% by weight and a specific surface area of 1.38 $m^2/g$ This means that a deposit of 100% crospovidone-iodine with a filter area of 20 $cm^2$ provides a sterile filtrate even when 100 ml of unfiltered material is contaminated with $10^9$ organisms. With the same contamination, the PVPP deposit provides a filtrate with $10^8$ organisms in 100 ml, and the kieselguhr and perlite deposit provides a filtrate with $10^7$ organisms in 100 ml. The crospovidone-iodine deposit thus has a sterilizing efficiency which is 7 powers of ten better than deposits of conventional filtration aids.

Sterilization of cooling lubricants containing mold spores

A validation was carried out by the test method indicated above with a cooling lubricant based on organic polymers (Oemeta HF AS, supplied by Oemeta) and containing mold spores. Once again, the crospovidone-iodine deposit was compared with corresponding PVPP and kieselguhr/perlite deposits.

| | LRV |
|---|---|
| Deposit of 100% crospovidone-iodine[+)] | 7 |
| Deposit of PVPP | 2 |
| Deposit of kieselguhr/perlite | 3 |

[+)]PVPP-$I_2$ with an average particle diameter of 52 $\mu$m, an available iodine content of 10.7% by weight and a specific surface area of 2.3 $m^2/g$ This means that a crospovidone-iodine deposit with a filter area of 20 $cm^2$ provides a sterile filtrate even when 100 ml of unfiltered material are contaminated with $10^7$ organisms. With the same contamination, the PVPP deposit provides a filtrate with $10^5$ organisms in 100 ml and the kieselguhr/perlite deposit provides a filtrate with $10^4$ organisms in 100 ml. This means that the crospovidone-iodine deposit has a sterilizing efficiency better by 4 powers of ten.

We claim:

1. A process for treating cooling lubricants to prevent attack by microorganisms using crospovidone-iodine as biocidal substance, wherein the cooling lubricant to be treated is brought into contact with a filter cake which consists essentially of particulate crospovidone-iodine as filter medium.

2. A process as claimed in claim 1, wherein a suspension of crospovidone-iodine is metered into the contaminated cooling lubricant to be treated upstream of a filter apparatus comprising the filter cake.

3. A process as claimed in claim 1, wherein the crospovidone-iodine is stirred into the cooling lubricant to be treated and, after acting for a time between 1 and 300 sec, is placed in a filter apparatus comprising the filter cake.

4. A process as claimed in claim 1, wherein the filter cake is produced in situ by deposition on a filter support.

5. A process as claimed in claim 2, wherein the suspension comprises 1 to 30% by weight crospovidone-iodine.

6. A process as claimed in claim 2, wherein 0.5 to 200 ml of the suspension are added per liter of cooling lubricant.

7. A process as claimed in claim 1, which is carried out with the aid of a belt filter apparatus.

8. A process as claimed in claim 1, which is carried out with the aid of a candle filter apparatus for precoat filtration.

9. A process as claimed in claim 1, wherein a horizontal filter apparatus is used.

10. A process as claimed in claim 1, wherein a gravel bed filter is used.

11. A process as claimed in claim 1, wherein a filter press is used.

12. A process as claimed in claim 1, wherein the crospovidone-iodine has particle sizes in the range from 0.1 to 1000 $\mu$m.

13. A process as claimed in claim 1, wherein the crospovidone-iodine has particle sizes in the range from 2 to 400 $\mu$m.

14. A process as claimed in claim 1, wherein the crospovidone-iodine has particle sizes in the range from 80 to 120 $\mu$m.

15. A process as claimed in claim 1, wherein the available iodine content of the crospovidone-iodine is 1 to 22% by weight.

16. A process as claimed in claim 1, wherein the available iodine content of the crospovidone-iodine is 9 to 20% by weight.

17. A process as claimed in claim 1, wherein the available iodine content of the crospovidone-iodine is 15 to 18% by weight.

* * * * *